United States Patent [19]

Capecchiacci et al.

[11] 4,308,512

[45] Dec. 29, 1981

[54] MODULAR AIR CORE COIL INDUCTANCE ASSEMBLY

[76] Inventors: Giorgio Capecchiacci, via Pellizzari, 32 Vimercate, Milano; Eugenio Mainardi, via Ronchi, 14 Pescara, both of Italy

[21] Appl. No.: 56,157

[22] Filed: Jul. 9, 1979

[30] Foreign Application Priority Data

Jul. 21, 1978 [IT] Italy ..... 25951 A/78

[51] Int. Cl.[3] ..... H01F 27/08; H01F 27/30

[52] U.S. Cl. ..... 336/57; 336/60; 336/84 C; 336/180; 336/207

[58] Field of Search ..... 336/207, 84 R, 84 C, 336/57, 59, 60, 55, 197, 65, 185, 180

[56] References Cited

U.S. PATENT DOCUMENTS

| | | | |
|---|---|---|---|
| 1,311,725 | 7/1919 | Takasaki et al. | 336/185 |
| 1,317,003 | 9/1919 | Creighton | 336/185 X |
| 1,466,253 | 8/1923 | Skinner | 336/60 X |
| 1,489,371 | 4/1924 | Steinberger et al. | 336/207 |
| 1,621,456 | 3/1927 | Brown et al. | 336/207 |
| 1,624,896 | 4/1927 | Veitch | 336/185 X |
| 1,652,938 | 12/1927 | Hewlett | 336/185 |
| 2,892,168 | 6/1959 | Seidel et al. | 336/207 |

*Primary Examiner*—Thomas J. Kozma

*Attorney, Agent, or Firm*—Hubbell, Cohen, Stiefel & Gross

[57] ABSTRACT

The present invention preferably comprises a modular air core coil inductance assembly which is comprised of a plurality of spiral windings which are magnetically coupled to each other and disposed in planes which are orthogonal to the longitudinal axis of the resultant air core coil. The modular air core coil assembly may preferably comprise a plurality of air core coil subassemblies each of which preferably comprises at least one spiral winding disposed on a winding support member, with the winding preferably being an electrical conductor wound in the shape of an Archimedes spiral disposed in a plane orthogonal to the longitudinal axis of the coil; a fixing or holding member which is disposed facing the spiral winding in order to set or hold it in position; at least two shields fixed on the coil ends in order to prevent magnetic coupling between the different coils; and at least two spacing members disposed so as to obtain the desired distance between the shield and the winding.

In order to assemble a single coil or subassembly, at least one winding support having a spiral winding disposed thereon is provided along with a holding member, a pair of spacing members and a pair of external shields, all of which are bolted together. If additional coils or subassemblies are added along the longitudinal axis, these too are preferably bolted together with the external ends of the various coils being connected together. In addition, a blower or ventilator fan may be disposed at one end of the modular air core coil inductance assembly along the longitudinal axis of the assembly in order to generate air flow along this axis.

21 Claims, 13 Drawing Figures

VE
100
SCH
G2
G3
CQ'''
G4
GR
G1
SAS1
SCH1
SCH2
C. SAS2
C. SAS1
SAS2
SAS1
102a
D'
D
TE1
TE'1
TE2
TE'2
TEi
TE'i
TEm
TE'm
TEn
TE'n
T
T'
Li
Pi
Lm
Pm
Ln
Pn
AS1
AS2
ASi
ASm
ASn
S1
S2
Sn
4
4'
1
1'
2
2'
3
5
6
7
8

CQ
RA1
RA2
RA3
V1
V2
V3
NC
SAS
TE1
TE'1
AS
CAS
C.SAS
CQ'
CQ"
V
X
Y

MODULAR AIR CORE COIL INDUCTANCE ASSEMBLY

BACKGROUND OF THE INVENTION

1. Field of the Invention

The present invention generally relates to modular inductance coils and, in particular, to air core coils of the type used for impedance matching of high power radio transmission antennas such as for use in the normal high frequency range, such as 1.5 to 30 MHz.

2. Description of Prior Art

High power radio transmitters and receivers (hereinafter transceivers) generally include a low power transceiver connected to some form of input, a high power amplifier, an antenna tuner and an antenna. In such prior art systems, the tuner has the important function of matching the antenna impedance to that of the high power amplifier for enabling the most efficient power transfer therebetween. Difficulty in accomplishing this function may result from the wide frequency band which causes the antenna impedance to vary greatly, according to frequency. For example, the impedance of a 5 meter long whip antenna (as represented in complex number form) can vary between 3−j1500 at 2 MHz and 800+j900 at 20 MHZ.

According to a prior art conventional technique which is widely used to compensate for variations in antenna impedance, an impedance matching network is employed which is composed of continuously variable coils and capacitors operated by servo-motors. Such a network is complex and the requisite tuning is accomplished by sophisticated closed-loop servo systems which are quite anachronistic in modern electronic equipment and which suffer from serious limitations such as (1) low reliability owing to the use of moving parts; (2) excessive tuning time (rarely less than 10 seconds, and often in high power equipment exceeding one minute); and (3) difficult maintenance due to system complexity and the sophistication of the individual parts thereof.

In a prior art effort to overcome the disadvantages of this servo motor approach, the motors have been replaced with high frequency relays thus producing static networks. According to this prior art approach, variable inductance and capacitance is provided by a finite set of reactive elements connected through these relays. These reactances can assume a discrete number of impedance values thus allowing the closed-loop control of the network to become discrete instead of continuous as in the previous prior art approach. As a result, any consequent inaccuracy in the requisite impedance matching can be reduced to acceptable limits.

Included in this latter approach is a step variable inductance usually consisting of "n" inductances with impedance values in binary progression and connected in series. Each coil is shunted by a relay contact in order to control the coil connection. This form of variable inductance can provide $2^n$ values of impedance at a given frequency, where "n" equals the number of inductances.

Unfortunately, a plurality of coils has a much higher volume than a single coil for a given inductance value and technology level. This is not considered a problem for low power matching networks such as those having a power of less than 100 watts, because in such a case small ferrite-core coils can be used. However, when air core coils are employed, such as those which must be used for higher power systems and which are configured as toroidal coils and single layer solenoids, size problems are presented which are not easily overcome through merely using a plurality of inductance elements. In an effort to overcome these problems, the prior art has attempted to reduce the volume required for the air core coils by employing a multilayer solenoid configuration. While this solution is theoretically very efficient, in practice it is very difficult to execute. In this regard, by way of example, a three layer solenoid could be obtained by winding one layer on each of three coaxial supports assembled in a complex support structure. Each winding, in the shape of a solenoid, would be made by a conductor with circular section and contained in suitable grooves. The three windings would be connected in series in order to generate magnetic flux in the same direction. In order to provide an idea of the possible size reduction in such arrangement, it should be noted that the inductance of a three layer solenoid could be considered, with very rough approximation, to be nine times higher than the one constituted by a single central layer. However, in spite of this advantage, the preparation of such a multilayer solenoid is quite difficult because of serious difficulty in constructing the required complex support, difficult in assembly of the windings, a lack of flexibility due to only a few values of inductance being feasible for a particular optimum size support, difficult cooling of the assembly, and difficult coil assembly if a step variable inductance is required. These disadvantages of the prior art are even more apparent when such a coil assembly is to be employed for an antenna tuner since multilayer solenoids having as many as five to ten layers, as opposed to the three referred to above, would normally be required.

These disadvantages of the prior art are overcome by the present invention.

SUMMARY OF THE INVENTION

The present invention preferably comprises a modular air core coil inductance assembly which is comprised of a plurality of spiral windings which are magnetically coupled to each other and disposed in planes which are orthogonal to the longitudinal axis of the resultant air core coil. The modular air core coil assembly may preferably comprise a plurality of air core coil subassemblies, each of which preferably comprises at least one spiral winding disposed on a winding support member, with the winding preferably being an electrical conductor wound in the shape of an Archimedes spiral disposed in a plane orthogonal to the longitudinal axis of the coil; a fixing or holding member which is disposed facing the spiral winding in order to set or hold it in position; at least two shields fixed on the coil ends in order to prevent magnetic coupling between the different coils; and at least two spacing members disposed so as to obtain the desired distance between the shield and the winding.

In accordance with a presently preferred embodiment of the present invention, the winding support member preferably comprises a frame having a parallelepiped external configuration with a central nucleus and radial arms extending therefrom and empty sectors between these arms. On the surface of the radial arms there are preferably disposed "n" number of circular grooves having an associated depth and width corresponding to the cross-section of the electrical conductor comprising the winding with the grooves being radially disposed so as to provide a winding in the shape of an Archimedes spiral. In addition, as presently preferred, the holding member may preferably comprise an element identical to the winding support member except for the replacement of the circular grooves with a single groove disposed in the radial direction. Similarly, the spacing member preferably has the same external frame as both the winding support member and the holding member; however, the spacing member has neither a nucleus, radial arms nor grooves.

Furthermore, in accordance with the present invention the presently preferred modular air core coil inductance assembly in constructed in the following manner. Preferably, the winding support members are molded from glass-reinforced silicon resin or equivalent in the shape of an external frame having an aperture at each corner, a central nucleus and three arms radially extending from the nucleus. As was previously mentioned, on the surface of each radial arm spiral grooves are preferably disposed. The electrical conductor which comprises the winding is preferably inserted in these grooves in order to obtain an Archimedes spiral with one end of the winding being disposed on one side of the radial arm and the other end being disposed on the opposite side of the radial arm. The aforementioned holding and spacing members may preferably be molded in either the same resin or a different resin from that of the winding support member. In order to assemble a single coil or subassembly, at least one winding support having a spiral winding disposed thereon is provided along with a holding member, a pair of spacing members and a pair of external shields, all of which are bolted together. If additional coils or subassemblies are added along the longitudinal axis, these too are preferably bolted together with the external ends of the various coils being connected together. In addition, a blower or ventilator fan may be disposed at one end of the modular air core coil inductance assembly along the longitudinal axis of the assembly in order to generate air flow along this axis.

DETAILED DESCRIPTION OF PREFERRED EMBODIMENTS

Figures 1, 2, 6:
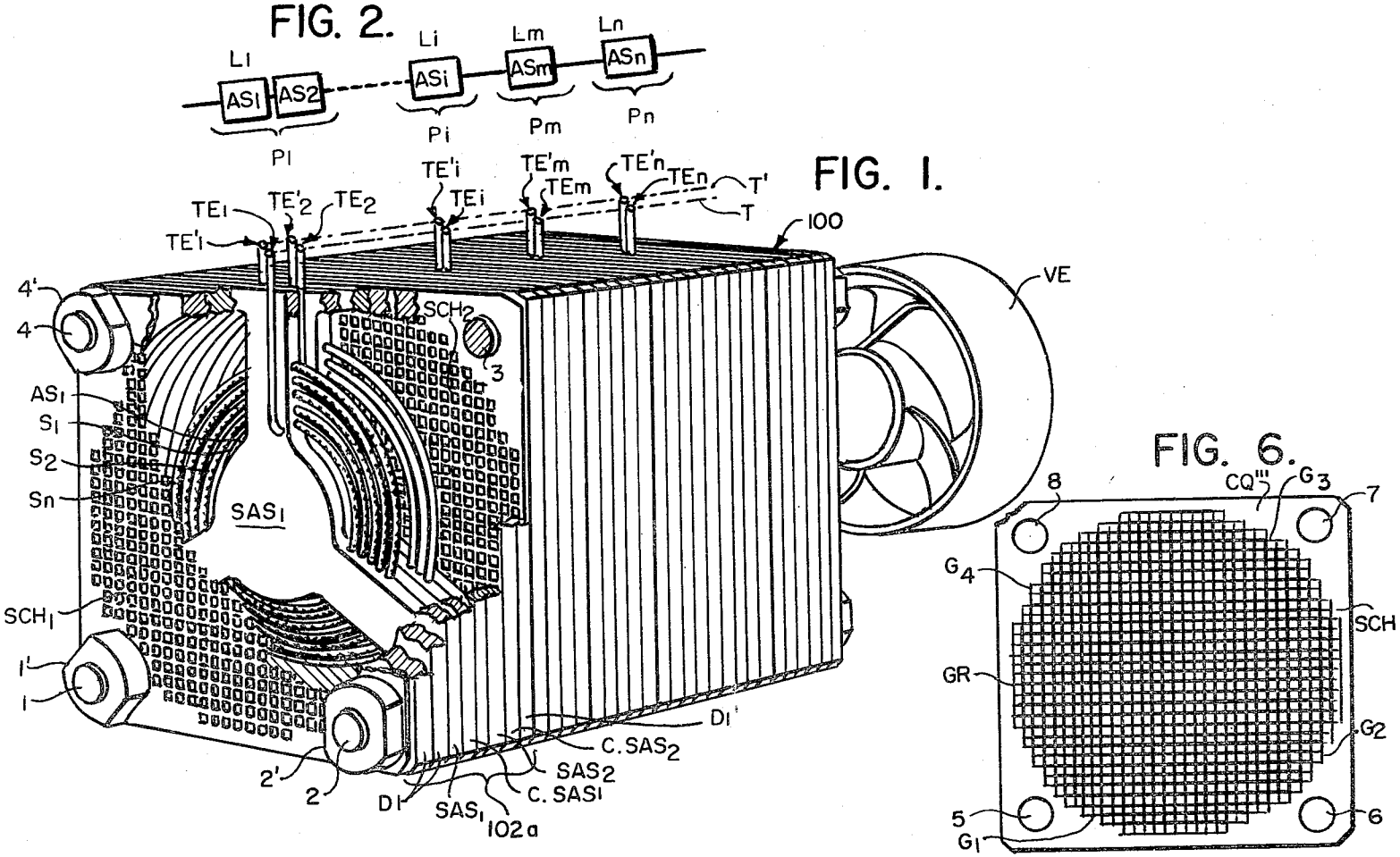
FIG. 1 is a partially sectioned perspective view of a set of air core coils constructed in accordance with a presently preferred embodiment of the present invention.
FIG. 2 is a schematic diagram of the embodiment of FIG. 1.
FIG. 6 is a front elevational view of a shield as shown in FIG. 1.

FIG. 1 illustrates a partially sectioned perspective view of a presently preferred embodiment of a modular air core coil inductance assembly 100 coil set in accordance with the present invention. The assembly 100 preferably comprises a plurality of coil packs or subassemblies 102*a*, 102*b*, 102*c*, 102*d*, indicated at $P_1$, $P_2 \ldots P_n$ in the schematic of FIG. 2. Each coil pack or subassembly 102*a*, 102*b*, 102*c*, 102*d* preferably includes (from left to right in FIG. 1) a stacked arrangement of an external shield $SCH_1$; two spacing members DI; a first spiral winding $AS_1$ contained in a first winding support member $S.AS_1$ and formed by an electrical conductor $F_1$ which starting, for example, from the end $TE_1$, preferably describes an Archimedes spiral on the support $S.AS_1$ and ends up at $TE'_1$; a holding or fixing member $C.SAS_1$; a second spiral winding $AS_2$ contained in a second winding support member $S.AS_2$; one or more additional spacing members DI'; and a second shield $SCH_2$.

Each coil pack or subassembly $P_i$ assumes an inductance value $L_i$ and therefore the electric equivalent diagram of the complete coil set or modular assembly 100 is as shown in FIG. 2. Consequently, the n coils $P_1 \ldots P_n$ may be represented by inductances $L_1, L_2 \ldots L_m, L_{n-1}, L_n$. A plurality of coil packs or subassemblies 102*a*, 102*b*, 102*c*, 102*d* with through bolts 1, 2, 3, 4 on the threaded ends of which are screwed the nuts 1', 2', 3' (not shown in FIG. 1), 4' to form the completed modular assembly 100. As shown and preferred in FIG. 1, a blower VE is mounted on one end of the coil set or modular subassembly 100 for facilitating cooling thereof through an axial air flow along the longitudinal axis 104 of the assembly 100.

Figures 3, 3A, 3B, 3C, 4, 4A, 4B, 4C, 5, 5A:
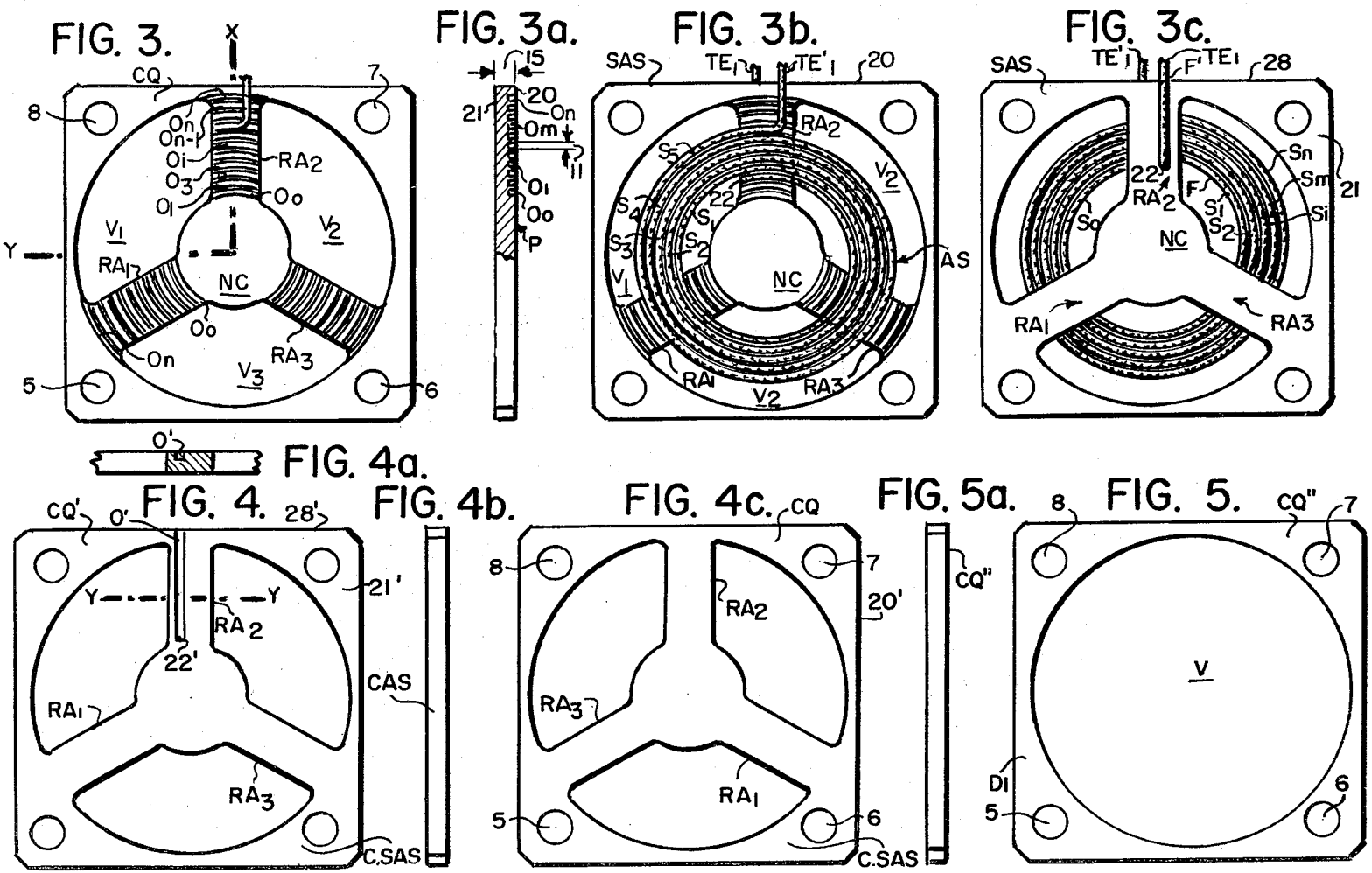
FIG. 3 is a front elevational view of one side of a winding support member as shown in FIG. 1.
FIG. 3*a* is a partially sectioned end view of the support of FIG. 3 taken along view lines a—a.
FIG. 3*b* is the same view as FIG. 3 with a spiral winding installed on the support.
FIG. 3*c* is a rear elevational view of the opposite side of the support of FIG. 3*b;*
FIG. 4 is a front elevational view of one side of a holding or fixing member as shown in FIG. 1.
FIG. 4*a* is a sectioned partial view of the holding member of FIG. 4 taken along view line a—a.
FIG. 4*b* is an end view of the member of FIG. 4 taken along view line b—b.
FIG. 4*c* is a rear elevational view of the opposite side of the holding member of FIG. 4.
FIG. 5 is a front elevational view of one side of a spacer member as shown in FIG. 1.
FIG. 5*a* is a sectional view of the spacer member of FIG. 5 taken along view line a—a.

FIGS. 3, 3*a*, 3*b* and 3*c* illustrate a typical one of n coil windings, which preferably form an Archimedes spiral AS, and its associated winding support member S.AS. Particularly, FIG. 3*b* represents a front elevational view of winding support member S.AS. As shown and preferred in FIG. 3*b*, the face of winding support member S.AS. illustrated therein contains the spiral AS. FIG. 3*c* illustrates the opposite face and winding support member S.AS, with the end $TE_1$ of the spiral AS protruding therefrom. FIGS. 3 and 3*a* illustrates the front view (similar to FIG. 3*c*) and the cross-sectional end view of the winding support member S.AS, respectively, prior to insertion of the coil winding AS.

In order to facilitate the comprehension of the invention, the winding support member S.AS itself will first be described. As shown and preferred in FIG. 3, the winding support member S.AS is an element having a parallelepiped external configuration CQ comprising three empty or hollow sectors $V_1$, $V_2$, $V_3$ (e.g. obtained by removal of material), which are defined by a central nucleus NC and three radially extending arms $RA_1$, $RA_2$ and $RA_3$. Preferably, at each corner of winding support member S.AS there is an aperture 5, 6, 7, 8 of sufficient size to enable insertion of a bolt 1, 2, 3, 4, therethrough, such as illustrated in FIG. 1. In the presently preferred embodiment of the invention, only one face (20) of the radial arms $RA_1$, $RA_2$, $RA_3$ is provided with a plurality of arcuate concentric grooves $0_i$, with these concentric grooves $0_i$ extending from the most internal concentric groove $0_o$ to the most external concentric groove $0_n$. As shown and preferred in FIG. 3*a*, the depth of each groove $0_i$ is only a fraction of the thickness 15 of the radial arm $RA_2$, such as for example one third of such thickness. The concentric grooves $0_i$ are preferably disposed along each arm $RA_1$, $RA_2$, $RA_3$ in such a way that their middle or center lines lie upon an Archimedes spiral. Moreover, the depth "p" and the width "li" of each such concentric groove preferably corresponds to the diameter of the conductor F of the winding AS so as to retain and keep fixed therein the winding forming conductor, as illustrated in FIGS. 3*b* and 3*c*. For example, for a conductor having a diameter of 2 mm, the concentric grooves would each have a depth "p" of 2.01 mm and a width "li" of 2.1 mm.

In particular, as shown and preferred in FIGS. 3*a*, 3*b* 3*c*, the conductor F with its free end $TE_1$ on the non-grooved face 21 (FIGS. 3*a*, 3*c*) passes through the aperture 22 provided on radial arm $RA_2$ from rear face 21 to front face 20, and is inserted into the concentric groove $0_2$ in which aperture 22 is disposed and wound in the shape of an Archimedes spiral by insertion into the other concentric groove $0_i$, forming five loops, by way of example, from $S_1$ up to $S_5$ (FIGS. 3*b*, 3*c*). As shown and preferred in FIGS. 3*b* and 3*c*, at the end of loop $S_5$, the conductor wire F turns upwards forming the opposite end $TE'_1$ parallel to end $TE_1$ but spaced therefrom. Preferably, as shown in FIG. 1, all of these ends $TE_1$, $TE_2$ . . . $TE_n$ of the windings $AS_1$, $AS_2$ . . . $AS_n$ are aligned with each other (along a line T), while the other ends $TE'_1$, $TE'_2$ . . . $TE'_n$ are also aligned with each other (along another line T' which runs parallel to line T at a distance of several centimeters, such as 10 centimeters therefrom).

Some fundamental advantages of the invention can be immediately understood from the aforesaid figures, particularly the great flexibility in obtaining a wide range of inductance values. For example, the radial arms $RA_1$, $RA_2$ and $RA_3$ enable a high number of concentric grooves (from $0_o$ to $0_n$), such as at least 10 grooves to be provided on which at least nine loops $S_1$–$S_n$ can be wound. Thus, a wide range of inductance values can be easily achieved by varying the different construction parameters from one coil to the next, such as by varying the number of loops $S_i$ in a spiral coil $AS_i$; the diameters of the loops $S_i$; and/or the number of spiral coils mutually and magnetically coupled and forming the same coil $AS_i$ of a coil pack $P_i$ or subassembly 102*a*, 102*b*, 102*c*, 102*d*. Furthermore, if desired, both the diameter and the type of wire F can be varied from one spiral winding AS to another, although for construction reasons it would be useful to keep them constant from one subassembly to the next. In the presently preferred embodiments, if good electrical conductivity is desired, enamel insulated (or silver coated) copper wire is suggested for conductor F.

As shown and preferred in FIG. 1, each winding support member S.AS of a typical coil subassembly 102*a* is normally followed by a typical holding or fixing member C.SAS of the type illustrated in FIGS. 4, 4*a*, 4*b* and 4*c*, by way of example. This holding member C.SAS preferably has the same general configuration CQ' as winding support S.AS, as well as also having similarly disposed radial arms $RA_1$, $RA_2$ and $RA_3$ and nucleus NC. However, the radial arms $RA_1$, $RA_2$ and $RA_3$ of the holding member C.SAS preferably do not have any of the previously discussed concentric grooves $0_i$ contained in winding support SAS, although the holding member C.SAS does include front and rear surfaces 20' and 21', respectively, on opposite sides thereof as well as apertures 5, 6, 7 and 8 (alignable with similar apertures in support SAS in assembly 100) for insertion of the bolts, 1, 2, 3, and 4. The front surface 20' of holding member C.SAS is intended to abut the front surface 20 of the winding support S.AS in the assembled coil subassembly 102*a* and thereby hold or fix the conductor F in place in the concentric grooves $0_i$ of winding support S.AS. Preferably, the radial arm $RA_2$ of holding member C.SAS is provided with a radially extending groove 0' (FIG. 4), disposed on the rear side 21', with groove 0' preferably having the same size (depth "p" and width "li") as the previously mentioned concentric grooves $0_i$ of the winding support SAS. This groove 0' is preferably disposed in radial arm $RA_2$ so as to extend from one end 22', corresponding to the location of aperture 22 in the face 21 of winding support S.AS, to the end 28' or outside of the holding member C.SAS. As shown and preferred, when the inductance coil subassembly 102*a* is assembled, this groove 0' preferably contains the vertical tract of wire $TE_1$ running from 22 to 28 (FIG. 3*c*). The rear surface 21' of holding member C.SAS shown in FIG. 4 preferably makes contact with the non-grooved rear surface 21 of the winding support SAS shown in FIG. 3*c* in the assembled coil subassembly 102*a*. FIG. 4*a* illustrates a fragmentary sectional view of the radial arm $RA_2$ having the aforementioned channel or groove 0'. It should be noted that, if desired, this radial groove 0' can be eliminated and/or replaced by retaining projections on face 21 and/or 20.

Referring now to FIGS. 5 and 5*a*, a typical spacing member DI is illustrated. Such a spacing member DI preferably has a configuration CQ'' similar to the configuration CQ and CQ' and alignable bolt holes 5–8 for the bolts 1–4 of the previously discussed winding support S.AS and holding support members C.SAS. The essential difference between the spacing member DI and both the winding support S.AS and the holding member C.SAS is that neither radial arms $RA_1$, $RA_2$, $RA_3$ nor a central nucleus NC is provided in spacing member DI. The purpose of spacing member DI is to separate the shields SCH from the winding AS at the two ends of each coil pack or subassembly 102*a*. Thus, the absence of any radial arms RA or central nucleus NC in DI facilitates air flow inside the coil modular assembly 100 through a large cavity V, such as one having a diameter of 18 cm., formed inside spacing member DI as a result of the absence of radial arms RA and a central nucleus NC.

With respect to the aforementioned shields SCH, a typical such shield SCH is illustrated in FIG. 6 which shows a front elevational view of such a typical shield SCH. As shown and preferred, shield SCH includes a thin conductor plate, such as one having a thickness of 1 mm, having an external configuration CQ''' identical to the configurations CQ, CQ' and CQ'' of the support, holding and spacing members S.AS, C.AS, DI, respectively. The four alignable bolt apertures 5, 6, 7 and 8 of this plate SCH correspond to those of winding support S.AS, holding member C.SAS and spacing member DI and are alignable therewith in the assembled coil subassembly 102*a*. As shown and preferred, the central area of SCH is constituted by a grid GR which has approximately the same circular shape and dimensions as the cavity V of the spacing member DI, with the meshes of the grid GR being arranged so as to obtain the maximum air flow, such as having a size of 2 mm.

As previously mentioned and as shown in FIG. 2, each coil pack $P_1, P_2 \ldots P_i, P_m \ldots P_n$ or subassembly 102 assumes an inductance value $L_1, L_2 \ldots L_i, L_m \ldots L_n$. In accordance with the present invention, any desired inductance value $L_i$ can readily be achieved by varying the coil construction parameters such as the number of loops $S_i$; the radial distances of the loops $S_i$ from the center NC; the number of mutually coupled spirals contained in the same coil pack $P_i$ or subassembly 102; and/or the mutual coupling among the spiral windings $AS_i$ of a single coil or the spacing therebetween.

FIG. 1 shows clearly how the number of loops $S_i$ and their distances from the center NC (configuration of a single spiral winding) and the mutual coupling (relative configuration of the windings in the same coil) can be varied to influence the inductance value. Thus, in the presently preferred embodiment illustrated in FIG. 1, the coil pack $P_1$ or subassembly 102*a* comprises two winding supports $S.AS_1$ and $S.AS_2$ with $S.AS_1$ having five loops from $S_1$ to $S_5$ laid out in the same way as in FIG. 3*b* and with $S.AS_2$ having three loops, disposed so that the external loop is further from the center than the external loop of the winding $AS_1$. In this case, the inductance $L_1$ of the coil pack $P_1$ or subassembly 102*a* may readily be determined by the addition of the partial inductances of $AS_1$ and $AS_2$, and of the mutual inductance between $AS_1$ and $AS_2$. Since this arrangement may be varied, this constructional flexibility allows any desired value of $L_i$ to be obtained on each single coil pack $P_i$ or subassembly 102 and, therefore, enables any desired total inductance value from the series of n inductances $L_1$–$L_n$ of the n coil packs $P_1$–$P_n$ or subassemblies 102 comprising the completed air core coil modular assembly 100. In addition, there are practically no limits with regard to the number of coils $P_i$ or subassemblies 102 because the winding supports S.AS, the holding members C.SAS, the spacing members DI and the shields SCH are all extremely light and of reduced size, such as a weight of 10 g and an overall size of 10×10 cm., and, because of their modular arrangement, are relatively easy to assemble by means of through bolts 1, 2, 3, 4 and the associated nuts 1', 2', 3', 4', with bolts 1, 2, 3, 4 being inserted through apertures 5, 6, 7 and 8, respectively, after the various members S.AS, C.SAS, DI, SCH which comprise the assembly 100 are properly aligned.

The winding supports $S.AS_i$ are preferably made of a thermosetting or thermoplastic resin, such as one preferably having excellent electrical properties such as low dielectric constant and low dissipation factor; excellent thermal stability at high temperatures; low weight and good mechanical properties. Among such thermoplastic or thermosetting resins, silicon, mixed with insulating and reinforcing materials such as fiberglass, mica, amianthus, etc., are presently preferred. For example, the winding supports S.AS could be composed of glass-reinforced silicone resin, which is readily commercially available. Similarly, the holding members C.SAS could be formed from the same material as the winding supports S.AS; however, other types of thermosetting resins (or even thermoplastic resins) can be used if desired. The same applies to the spacing members DI, which can be composed of an even wider range of materials than the holding members C.SAS or winding supports S.AS since the spacing members DI do not have mechanical functions in the assembly 100 but are merely used to separate the shields SCH from the winding supports S.AS or holding members C.SAS. With respect to these shields SCH, they are preferably composed of sheet aluminum or an alloy of copper (e.g., brass, phosphorous bronze, etc.), or some other equivalent material.

As previously mentioned, the total inductance of the air core coil modular assembly 100 is obtained by the addition of the inductances $L_1, L_2 \ldots L_n$ of the single coils $P_1, P_2 \ldots P_n$ or subassemblies 102. Thus, assuming $L_1, L_2 \ldots L_n$ can have any values, the preferred configuration consists of a series of inductances $L_1, L_2 \ldots L_n$ in binary progression; i.e., if $L_1=1$, the further inductance values are $L_2=2$, $L_3=4$, $L_4=8$, $L_5=16$ and so on. In such a binary progression, the coils $P_1-P_n$ or subassemblies 102 can readily be constructed from standard elements.

As shown and preferred in FIG. 1, an axial blower VE, such as a ventilator, can be mounted at one end of the air core coil modular assembly 100. The particular presently preferred configuration of the various modular members comprising assembly 100 facilitates efficient cooling of the windings, with the air tunnel which is formed inside the assembly 100 ensuring that the air flow, produced by the blower VE, is concentrated in the windings.

By way of example, two embodiments have been constructed which are believed to be particularly interesting and universal in the field of transceivers showing a large frequency band (i.e., from 2 to 30 MHz) and a high power (up to one or more kW).

EXAMPLE 1

The first such embodiment of the modular air core coil assembly 100 had the following arrangement:

$L_1$: one shield $SCH_1$, two spacing members $DI_1$, one winding support $S.AS_1$ with 7 coil loops starting from the 3rd pitch or groove, i.e., the Archimedes coil started on groove $0_3$, and three spacing elements $DI'_1$;

$L_2$: one shield $SCH_2$, two spacing members $DI_2$, one winding support $S.AS'_2$ having 6 coil loops starting from the 3rd pitch or groove $0_3$, one winding support $S.AS''_2$ having 5 coil loops starting from the 4th pitch or groove $0_4$, and three spacing members $DI'_2$;

$L_3$: one shield $SCH_3$, two spacing members, one winding support $S.AS'_3$ having 6 coil loops starting from the 3rd pitch or groove $0_3$, one winding support $S.AS''_3$ having 7 coil loops starting from the 3rd pitch or groove $0_3$, one winding support $S.AS'''_3$ having 6 coil loops starting from the 3rd pitch or groove $0_3$, and three spacing members; and $L_4$: one shield, two spacing members, one winding support $S.AS'_4$ having 7 coil loops starting from the 2nd pitch or groove $0_2$, one winding support $S.AS''_4$ having 7 coil loops starting from the 2nd pitch or groove $0_2$, one winding support $S.AS'''_4$ having 7 coil loops starting from the 2nd pitch or groove $0_2$, one winding support $S.AS''''_4$ having 6 coil loops starting from the 3rd pitch or groove $0_3$, three spacing members; and finally a shield.

EXAMPLE 2

The second such embodiment of the modular air core coil assembly had the following arrangement:

$1_1$: one shield, two spacing members, one winding support having one coil loop starting at the 1st pitch or groove $0_1$, two spacing members and one shield;

$1_2$: three spacing members, one winding support having one coil loop starting at the 9th pitch or groove $0_9$, three spacing members, and one shield;

$1_3$: two spacing members, one winding support having 2 loops starting at the 4th pitch or groove $0_4$, two spacing members, and one shield;

$1_4$: two spacing members, one winding support having 3 coil loops starting at the 3rd pitch or groove $0_3$, two spacing members, and one shield; and $1_5$: one winding support having 5 coil loops starting at the 1st pitch or groove $0_1$, two spacing members, and one shield.

In the above two exemplary embodiments, the inductance values of each modular air core coil assembly 100 were: $L_4=52$ μH; $L_3=26$ μH; $L_2=13$ μH; and $L_1=7$ μH for Example 1; and $1_5=3.5$ μH; $1_4=1.8$ μH; $1_3=1$ μH, $1_2=0.6$ μH; and $1_1=0.3$ μH for Example 2.

A practical advantage of the present invention is also the ease with which the construction details of the various coils can be defined. The examples indicated above demonstrate all of the information necessary in specifying individual coils or any combinations thereof.

In these two embodiments of the invention, the winding supports $S.AS_i$, the spacing members DI and the holding members C.SAS can preferably be prepared by injection molding a blend of a PPS (polyphenylsulfure) resin and of fiberglass (up to 40%). In particular, the PPS resin sold under the trademark "RYTON" by Phillips Petroleum Company is presently preferred. The characteristics of such PPS resins, particularly of "RYTON", as well as the compositions of their blends with reinforcing fiberglass can be found in the technical literature in the Phillips Petroleum catalogues for RYTONR-4 and RYTON R-6.

It should be noted that the desirability of a blower VE increases with the increase in the number of subassemblies 102 or coils $P_1$–$P_n$ comprising the assembly 100. In this regard, the specifications of the blower with regard to air flow, pressure drop, etc., generally will be dependent on power dissipation in the matching network. However, such a choice of a conventional blower VE is well within the ordinary skill in the art.

The enclosed figures show particular constructional shapes of the various modular components. These shapes are not the only ones possible, nor is the invention confined to the specific subassemblies or assembly described above since these are subject to modifications, replacements, improvements and so on, which can easily be performed within the ordinary skill in the art, and which fall within the scope of the appended claims.

By utilizing the modular assembly and method of the present invention an air core coil arrangement may be obtained having minimization of size, ease of mechanical assembly, efficient cooling, ease of accessibility for interconnection of coils, relays, high Q and high isolation and flexibility in composition and inductance value.

What is claimed is:

1. A modular air core coil assembly comprising at least one modular coil subassembly, said one subassembly having a longitudinal winding axis, at least one other modular air core coil subassembly coaxially aligned along said longitudinal axis with said one subassembly, said other modular air coil subassembly comprising at least one winding support member having a plurality of spaced apart winding retaining grooves disposed thereon concentric with said longitudinal axis, said support member comprising an air flow passage therethrough, at least one spiral winding electrical conductor disposed in a predetermined quantity of said grooves on one side of said support member, said quantity of grooves in which said conductor is disposed being dependent on the desired inductance value for said one subassembly, said grooves being arranged to form an Archimedes spiral winding for said winding lying in a plane orthogonal to said longitudinal axis with said air flow passage therethrough; at least one holding member disposed in juxtaposition with said support member with one face of said holding member being in contact relation with said one side of said support member carrying said spiral winding in order to hold said winding in position in said grooves; a magnetic shield member disposed at each of the ends of said one subassembly; and at least one spacing member disposed between each of said shield members and said winding support member for spacing said shield member from said winding support member, said winding support member, said holding member, said spacing member and said shield member each having an air flow passage therethrough and being coaxially aligned in juxaposition to each other along said longitudinal axis.

2. A modular air core coil assembly in accordance with claim 1 wherein said winding support member, said holding member, said spacing member and said shield member are removably connected to each other to form said subassembly.

3. A modular air core coil assembly in accordance with claim 2 wherein said assembly further comprises bolting means, each said winding support member, holding member, spacing member and shield member having a coaxially aligned bolt receiving through aperture therein, said bolt means being insertably retained in said coaxially aligned bolt receiving through apertures for removably connecting said winding support member, holding member, spacing member and shield member together in said subassembly.

4. A modular air core coil assembly in accordance with claim 1 wherein said assembly further comprises an air blower means disposed at one end thereof for coaxially directing air flow along said longitudinal axis through said air flow passages for cooling said assembly.

5. A modular air core coil assembly in accordance with claim 4 wherein each of said air flow passages is coaxially aligned.

6. A modular air core coil assembly in accordance with claim 1 further comprising at least another modular air core coil subassembly coaxially aligned along said longitudinal axis with said one subassembly, said other another modular air coil subassembly comprising at least one winding support member having a plurality of spaced apart winding retaining grooves disposed thereon concentric with said longitudinal axis, said support member comprising an air flow passsage therethrough, at least one spiral winding electrical conductor disposed in a predetermined quantity of said grooves on one side of said support member, said quantity of grooves in which said conductor is disposed being dependent on the desired inductance value for said one subassembly, said grooves being arranged to form an Archimedes spiral winding for said winding lying in a plane orthogonal to said longitudinal axis with said air flow passage therethrough; at least one holding member disposed in juxtaposition with said support member with one face of said holding member being in contact relation with said one side of said support member carrying said spiral winding in order to hold said winding in position in said grooves; a magnetic shield member disposed at each of the ends of said one subassembly;

and at least one spacing member disposed between each of said shield members and said winding support member for spacing said shield member from said winding support member, said winding support member, said holding member, said spacing member and said shield member each having an air flow passage therethrough and being coaxially aligned in juxaposition to each other along said longitudinal axis; said subassemblies being disposed in juxtaposition with each other along said longitudinal axis with said spiral windings being magnetically coupled to each other and disposed in parallel planes.

7. A modular air core coil assembly in accordance with claim 6 wherein said parallel planes are orthogonal to said longitudinal winding axis.

8. A modular air core coil assembly in accordance with claim 6 wherein each of said subassemblies is removably connected to each other to form said assembly.

9. A modular air core coil assembly in accordance with claim 8 wherein each of said winding support members, holding members, spacing members and shield members are removably connected to each other to form said subassemblies whereby the associated inductance parameters of said assembly may be modularly varied.

10. A modular air core coil assembly in accordance with claim 6 wherein said assembly further comprises bolting means, each of said winding support members, holding members, spacing members and shield members has a coaxially aligned bolt receiving through aperture therein, said bolting means being insertably retained in said coaxially aligned bolt receiving through apertures for removably connected said winding support members, holding members, spacing members and shield members together in said assembly.

11. A modular air core coil assembly in accordance with claim 6 wherein said assembly further comprises an air blower means disposed at one end thereof for coaxially directing air flow along said longitudinal axis through said air flow passages for cooling said assembly.

12. A modular air core coil assembly in accordance with claim 11 wherein each of said air flow passages are coaxially aligned.

13. A modular air core coil assembly in accordance with claim 1 wherein said winding support member comprises a frame having a parallelepiped external configuration, a central nucleus and radial arms extending therefrom and having empty sectors between said arms, said empty sectors comprising said air passage therethrough.

14. A modular air core coil assembly in accordance with claim 13 wherein said concentric grooves comprise a plurality of circular grooves disposed on only one surface of said arms, with each of said grooves having an associated width and depth corresponding to the cross-section of said conductor and being radially spaced apart so as to obtain said winding in the shape of said Archimedes spiral.

15. A modular air core coil assembly in accordance with claim 14 wherein a radial groove is disposed in a face of one of said arms opposite to the face on which said circular grooves are disposed, said Archimedes spiral forming conductor having a first radial section protruding from said subassembly to form an outer terminal and an opposite end forming another end terminal, said conductor being disposed in a radial direction in said radial groove of said non-grooved face of said winding support member, said one arm containing an aperture therethrough, said conductor passing through said aperture in said one arm to said grooved face and being disposed in said circular concentric grooves and wound in said shape of said Archimedes spiral, moving from the internal loop to the external loop of said spiral and turning upward in a radial direction to form said other end terminal.

16. A modular air core coil assembly in accordance with claim 15 wherein said holding member comprises a frame having a parallelepiped external configuration substantially identical to said winding support and a symmetrically disposable nucleus and arms but with only one groove disposed in said radial direction and corresponding to said end of said conductor disposed in said radial direction.

17. A modular air core coil assembly in accordance with claim 16 wherein said spacing member comprises the same external frame configuration as both said winding support member and said holding member, but with neither nucleus nor arms disposed therein.

18. A modular air core coil assembly in accordance with claim 17 wherein said shield member comprises an outer frame having a configuration substantially identical to that of said spacing member and a central area constituted by a grid.

19. A modular air core coil assembly in accordance with claim 1 wherein said shield member outer frame is formed from a sheet aluminum or alloy and said grid is formed from a light metallic alloy.

20. A modular air core coil assembly in accordance with claim 1 wherein said winding support member, said holding member and said spacing member are formed from a material selected from the group consisting of thermosetting and thermoplastic resins and blends including glass silicon resins and glass polyphenylsulfur resins.

21. A modular air core coil assembly in accordance with claim 6 wherein the series of inductances $L_1$, $L_2$ . . . $L_i$ . . . $L_n$ of the various windings $P_1$, $P_2$ . . . $P_i$ . . . $P_n$ comprising said assembly are in binary progression.

* * * * *